US007722154B2

(12) United States Patent
Katada

(10) Patent No.: US 7,722,154 B2
(45) Date of Patent: May 25, 2010

(54) INKJET RECORDING APPARATUS

(75) Inventor: Masahito Katada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 827 days.

(21) Appl. No.: 11/542,177

(22) Filed: Oct. 4, 2006

(65) Prior Publication Data

US 2007/0076047 A1 Apr. 5, 2007

(30) Foreign Application Priority Data

Oct. 5, 2005 (JP) ..... 2005-292655

(51) Int. Cl.
*B41J 2/165* (2006.01)

(52) U.S. Cl. ..... 347/33

(58) Field of Classification Search ..... 347/37, 347/104, 31, 32, 33
See application file for complete search history.

(56) References Cited

U.S. PATENT DOCUMENTS 5,670,996 A * 9/1997 Mitani ..... 347/29
5,718,793 A * 2/1998 Inamoto et al. ..... 156/235
5,923,354 A * 7/1999 Ikezaki ..... 347/88
5,997,128 A * 12/1999 Lou et al. ..... 347/33
6,352,334 B2 * 3/2002 Fukushima et al. ..... 347/33
6,598,957 B2 * 7/2003 Yamamoto et al. ..... 347/45
2004/0104961 A1 * 6/2004 Hashi et al. ..... 347/29

FOREIGN PATENT DOCUMENTS

JP 2003-154670 A 5/2003

* cited by examiner

*Primary Examiner*—Stephen D Meier
*Assistant Examiner*—Alexander C Witkowski
(74) *Attorney, Agent, or Firm*—Birch, Stewart, Kolasch & Birch, LLP

(57) ABSTRACT

The inkjet recording apparatus includes: an inkjet recording head having a long side extending in a lengthwise direction corresponding to a first movement direction perpendicular to a paper conveyance direction; a wiper blade which wipes a nozzle surface of the inkjet recording head in which a nozzle is formed; a first movement device which moves one of the inkjet recording head and the wiper blade in the first movement direction; and a second movement device which moves the wiper blade in a second movement direction which is substantially perpendicular to the first movement direction, in such a manner that the wiper blade wipes the nozzle surface, wherein the wiper blade is formed in such a manner that ink removing properties of at least one surface of the wiper blade become higher toward a first end section of the wiper blade in the first movement direction.

12 Claims, 16 Drawing Sheets

INKJET RECORDING APPARATUS

BACKGROUND OF THE INVENTION

1. Field of the Invention

The present invention relates to an inkjet recording apparatus, and more particularly, to an inkjet recording apparatus comprising a wiper blade which cleans a nozzle surface in which a nozzle for ejecting ink is formed.

2. Description of the Related Art

An inkjet recording apparatus (inkjet printer) is known, which comprises an inkjet head (liquid droplet ejection head) having an arrangement of a plurality of nozzles (liquid droplet ejection ports) which eject liquid, such as an ink, in the form of liquid droplets, and which forms images on a recording medium by ejecting the ink (ink droplets) from the nozzles toward a recording medium while causing the inkjet head and the recording medium to move relatively to each other.

The inkjet recording apparatus ejects ink from the nozzles toward a recording medium conveyed in the near vicinity of the nozzles, and hence the ink ejected onto the recording medium may bounce back and adhere to the nozzle surface, a portion of the ejected ink may remain on the nozzle surface, and such dirt as paper dust from the conveyed recording medium may adhere to the nozzle surface. When the nozzle surface becomes soiled in this way, then ejection defects arise in that the direction of flight of the ink droplets ejected from the nozzles is bent, or the nozzles become blocked and ink can no longer be ejected from the nozzles. In view of the circumstances, various methods have been proposed for cleaning the nozzle surface.

For example, Japanese Patent Application Publication No. 2003-154670 discloses an inkjet recording apparatus using a recording head which performs recording by ejecting liquid. In this inkjet recording apparatus, the front end section of a cleaning device for cleaning the liquid ejection unit of the recording head is curved in accordance with the nozzle surface of the recording head, and this cleaning device sweeps away ink adhering to the periphery of the ejection unit of the recording head. At least a portion of the cleaning device is formed by a member capable of guiding the swept ink in a prescribed direction in such a manner that, if a polyolefin fiber body is used as a cleaning member, for example, then the direction of the fibers and the direction in which the cleaning member guides the ink are substantially the same, whereby the ink swept from the recording head can be moved swiftly to a prescribed position.

However, according to the technology described in Japanese Patent Application Publication No. 2003-154670, cleaning of the recording head is performed by using a wiper blade as a cleaning device, and in particular if the wiper blade is shorter than the nozzle section of the recording head, a portion of the ink remaining in the vicinity of the contact section between the recording head and the wiper blade spills out onto either side of the wiper blade and remains on the nozzle surface. When ink remains on the nozzle surface in this way, a problem may arise in that the residual ink covers the peripheral regions of the nozzles and can give rise to ejection abnormalities.

In particular, when a long recording head is wiped in the conveyance direction of the paper, a long wiper blade which covers the whole of the nozzle section of the long recording head is required, and it is not easy to make the wiper blade be in contact with the recording head uniformly over the whole length of the long recording head, and wiping omissions leaving residual ink occur, which may give rise to ejection abnormalities as described above.

Moreover, in a mode where the recording head is wiped by moving it to a position outside the recording region, a wiper blade and a maintenance cap, and the like, are arranged in alignment outside the recording region, and hence there is also a problem in that the size of the apparatus increases in accordance with the length of the wiper blade, and the like.

SUMMARY OF THE INVENTION

The present invention is contrived in view of the aforementioned circumstances, an object thereof being to provide an image recording apparatus comprising a head cleaning device which readily makes tight contact uniformly with a head, reduces the occurrence of residual unwiped ink, and also makes it possible to make the apparatus compact, in order that print quality can be stabilized.

In order to attain the aforementioned object, the present invention is directed to an inkjet recording apparatus comprising: an inkjet recording head having a long side extending in a lengthwise direction corresponding to a first movement direction perpendicular to a paper conveyance direction; a wiper blade which wipes a nozzle surface of the inkjet recording head in which a nozzle is formed; a first movement device which moves one of the inkjet recording head and the wiper blade in the first movement direction; and a second movement device which moves the wiper blade in a second movement direction which is substantially perpendicular to the first movement direction, in such a manner that the wiper blade wipes the nozzle surface, wherein the wiper blade is formed in such a manner that ink removing properties of at least one surface of the wiper blade become higher toward a first end section of the wiper blade in the first movement direction.

According to this aspect of the present invention, during wiping, there is little residual ink at the end section having high ink removing properties, and furthermore the ink which is not removed from the wiper blade and remains thereon is guided toward the end section having low ink removing properties. Therefore, it is possible to reduce the amount of ink spilling out from the wiper blade at the end section having high ink removing properties, and consequently ejection reliability can be enhanced.

Preferably, a length of the wiper blade is shorter than a length of the nozzle surface of the inkjet recording head in the lengthwise direction.

According to this aspect of the present invention, the length of the wiper blade is short in this way. Hence, it is possible to achieve uniform tight contact between the wiper blade and the nozzle surface of the inkjet recording head, and therefore the ink can be wiped in a reliable fashion. Furthermore, since the wiper blade has a short length, it is possible to reduce the size of the apparatus.

Preferably, the inkjet recording apparatus further comprises an operational control device which controls the first movement device and the second movement device in such a manner that a first operation of wiping the nozzle surface by moving the wiper blade in the second movement direction, and a second operation of moving the wiper blade by a prescribed distance which is shorter than the length of the wiper blade in a direction which corresponds to both of the first movement direction and a direction from the first end section of the wiper blade toward a second end section of the wiper blade which is opposite to the first end section are alternately repeated, wherein the nozzle surface is wiped in such a manner that the first operation of wiping the nozzle surface is successively repeated in a direction from the first end section toward the second end section of the wiper blade.

Preferably, the inkjet recording apparatus further comprises an operational control device which controls the first movement device and the second movement device in such a manner that a first operation of wiping the nozzle surface by moving the wiper blade in the second movement direction, and a second operation of moving the inkjet recording head by a prescribed distance which is shorter than the length of the wiper blade in a direction which corresponds to both of the first movement direction and a direction from a second end section of the wiper blade which is opposite to the first end section toward the first end section of the wiper blade are alternately repeated, wherein the nozzle surface is wiped in such a manner that the first operation of wiping the nozzle surface is successively repeated in a direction from the first end section toward the second end section of the wiper blade.

According to these aspects of the present invention, it is possible to reliably wipe away ink on the whole of the nozzle surface.

Preferably, the wiper blade has a plurality of grooves formed in the at least one surface of the wiper blade in such a manner that density of the grooves becomes higher toward the first end section.

Preferably, the wiper blade has a plurality of grooves formed in the at least one surface of the wiper blade in such a manner that width of the grooves becomes broader toward the first end section.

According to these aspects of the present invention, the ink removing properties are higher in the end section where the grooves are formed in greater number or to a broader width, because of the capillary action of the grooves, and the ink which is not removed from the wiper blade and remains on the wiper blade is guided towards the side where the grooves are formed at lower density. Therefore, it is possible to prevent ink from spilling out onto the nozzle surface from the side of the wiper blade where the grooves are formed at high density, and hence ejection reliability can be improved.

Preferably, the wiper blade has a plurality of holes via which ink is suctioned by means of a suctioning device, in the at least one surface of the wiper blade, in such a manner that density of the holes becomes higher toward the first end section.

According to this aspect of the present invention, by actively collecting waste ink during wiping by suctioning the ink via the holes by means of a suctioning device, it is possible to readily dispose of the waste ink during wiping. Furthermore, the wiper blade is maintained in a clean state at all times, propulsion of ink caused by the restoring action of the wiper blade due to its elastic properties is reduced, and increased viscosity and solidification of the residual ink can be prevented.

Preferably, the wiper blade includes a plurality of porous members joined together in such a manner that ink absorptivities of the respective porous members become higher toward the first end section.

According to this aspect of the present invention, it is possible to increase the ink absorptivity in the wiper blade, and hence to improve the nozzle restoration properties during wiping of the nozzle surface, by means of the capillary action of the porous members.

Preferably, the wiper blade includes a heater which provides the wiper blade with a temperature gradient in such a manner that temperature of the wiper blade becomes higher toward the first end section.

According to this aspect of the present invention, when high-viscosity ink exceeding 10 mPa·s, for example, is used, the viscosity of the ink is reduced by heating the ink, thereby improving the wipeability of the ink. Furthermore, by providing a differential in the ink fluidity based on a differential in the ink viscosity, within the wiper blade, it is possible to reduce the amount of ink spilling out from the wiper blade at the one end section thereof.

Preferably, water repellency properties of the at least one surface of the wiper blade becomes higher toward the first end section.

According to this aspect of the present invention, it is possible to improve the characteristics of guiding ink towards the section having lower water repellency properties.

Preferably, a plurality of the nozzles are formed in the nozzle surface; the inkjet recording apparatus further comprises a first nozzle observation device which observes an ejection state of the nozzle; and if it has been determined by the first nozzle observation device that at least one of the nozzles suffers an ejection abnormality, a wiping operation is started from a region of the nozzle surface containing the at least one of the nozzles suffering the ejection abnormality.

Here, if a wiping operation is performed as described above, in other words, if the nozzle surface is wiped successively in a direction from the end section of the wiper blade having high ink removing properties toward the end section on the opposite side from same, by repeating in an alternating fashion, an operation of wiping the nozzle surface by the wiper blade in a direction substantially perpendicular to the lengthwise direction of the nozzle surface and an operation of moving the wiper blade or the inkjet recording head by a distance shorter than the length of the wiper blade, in the lengthwise direction of the nozzle surface, then it is possible to omit the wiping for a nozzle which does not require wiping, and it is also possible to reliably wipe away ink from a nozzle which does require wiping. Furthermore, by starting a wiping operation from a region containing a nozzle suffering an ejection abnormality, it is possible to avoid creating adverse effects in a normal nozzle due to unnecessary wiping, and hence ejection reliability can be improved.

Preferably, the inkjet recording apparatus further comprises a second nozzle observation device which observes the nozzle surface, wherein, if soiling on the nozzle surface has been determined by the second nozzle observation device, a wiping operation is started from a region of the nozzle surface containing an area of the soiling.

Here also, if the wiping operation is carried out as described above, then similarly, it is possible to omit the wiping for a nozzle which does not require wiping, and it is also possible to reliably wipe away ink from a nozzle which does require wiping. Furthermore, by starting a wiping operation from a region containing an area of soiling, it is possible to avoid creating adverse effects in a normal nozzle due to unnecessary wiping, and hence ejection reliability can be improved.

As described above, according to the present invention, during wiping, there is little residual ink at the end section having high ink removing properties, and furthermore, the ink which is not removed from the wiper blade and remains thereon is guided toward the end section having low ink removing properties. Therefore, it is possible to reduce the amount of ink spilling out from the wiper blade at the end section having high ink removing properties, and consequently ejection reliability can be enhanced.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIGS. 11A and 11B are illustrative diagrams showing a state at the start of wiping by a wiper blade, wherein FIG. 11A is a front view diagram and FIG. 11B is a side view diagram;

DETAILED DESCRIPTION OF THE PREFERRED EMBODIMENTS

Figure 1:
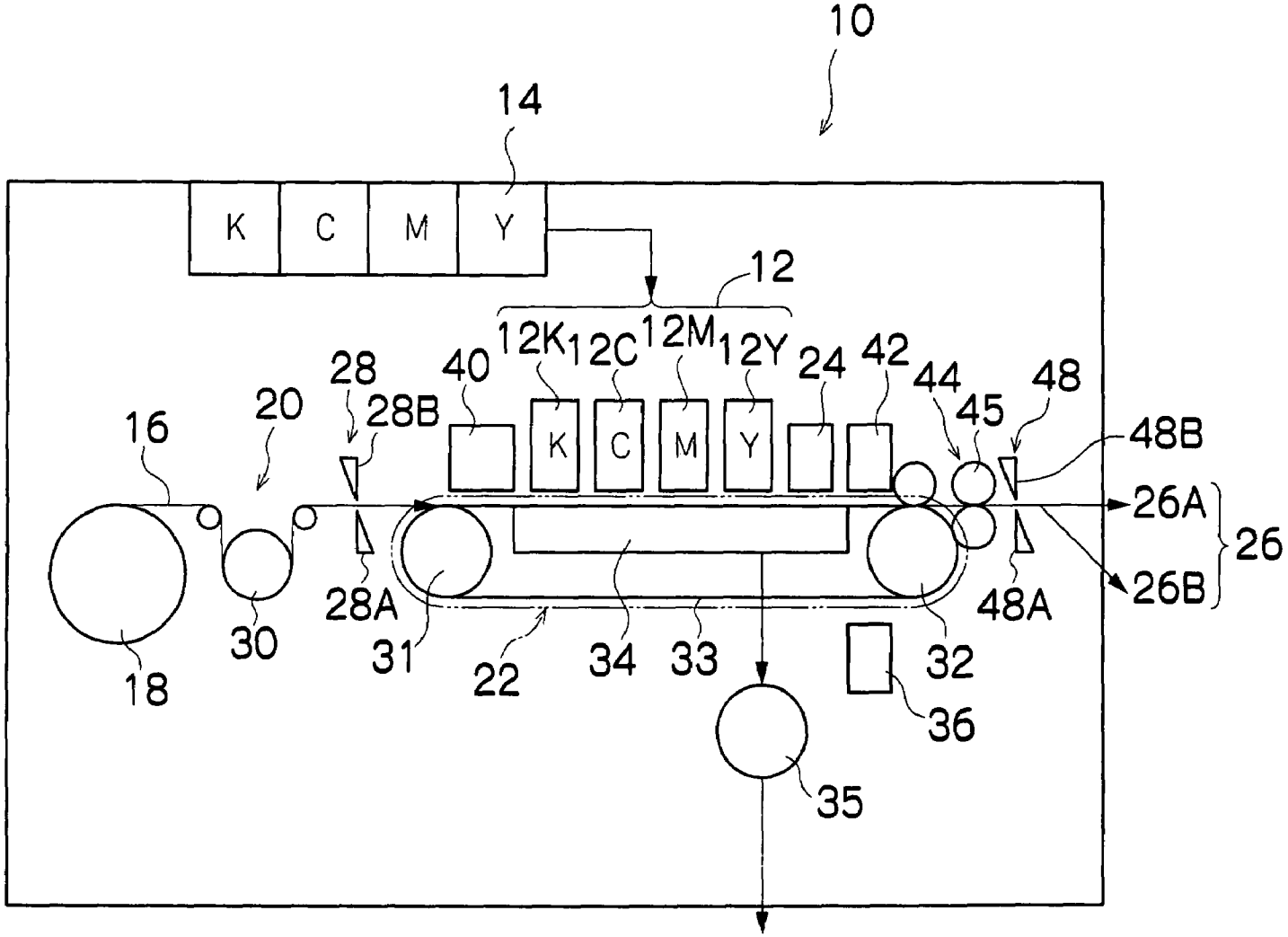
FIG. 1 is a general compositional view showing an approximate view of an inkjet recording apparatus relating to an embodiment of the present invention.

FIG. 1 is a general schematic drawing of an embodiment of an inkjet recording apparatus relating to an embodiment of the present invention.

As shown in FIG. 1, the inkjet recording apparatus 10 comprises: a printing unit 12 having a plurality of print heads (inkjet recording heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. At this time, the heating temperature is preferably controlled in such a manner that the recording paper 20 has a curl in which the surface on which the print is to be made is slightly rounded in the outward direction.

After decurling, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (a flat surface).

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and a negative pressure is generated by sucking air from the suction chamber 34 by means of a fan 35, thereby the recording paper 16 on the belt 33 is held by suction.

The belt 33 is driven in the clockwise direction in FIG. 1 by the motive force of a motor (not shown in Drawings) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the printing area passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

Figure 2:
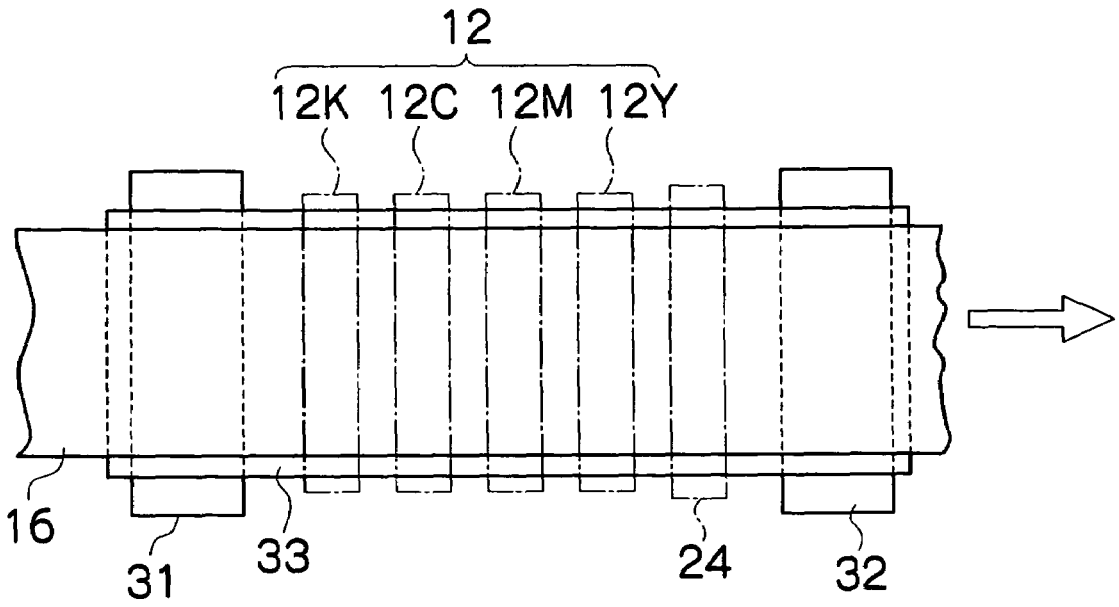
FIG. 2 is a plan view of a principal part of the peripheral area of a print unit in the inkjet recording apparatus illustrated in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10.

The print heads 12K, 12C, 12M, and 12Y are arranged in the order of black (K), cyan (C), magenta (M), and yellow (Y) from the upstream side (on the left hand side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) that is perpendicular to the paper conveyance direction.

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, and the like) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Figure 3A:
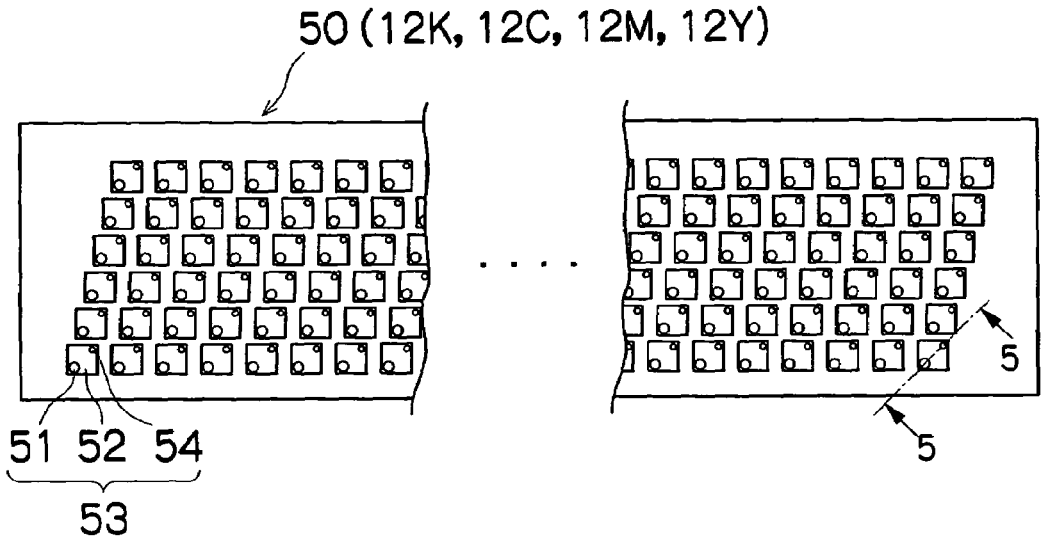
FIG. 3A is a plan view perspective diagram showing an embodiment of the structure of a print head.

Next, a print head is described below. The print heads 12K, 12C, 12M and 12Y provided for the respective ink colors each have the same structure, and a print head forming a representative embodiment of these print heads is indicated by the reference numeral 50. FIG. 3A shows a plan view perspective diagram of the print head 50 according to the present embodiment.

Figure 3B:
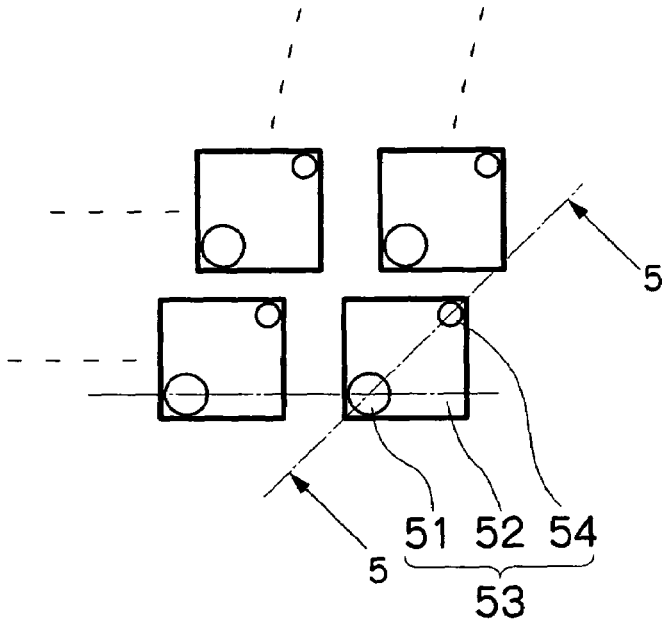
FIG. 3B is an enlarged diagram of a portion of same.
Figure 4:
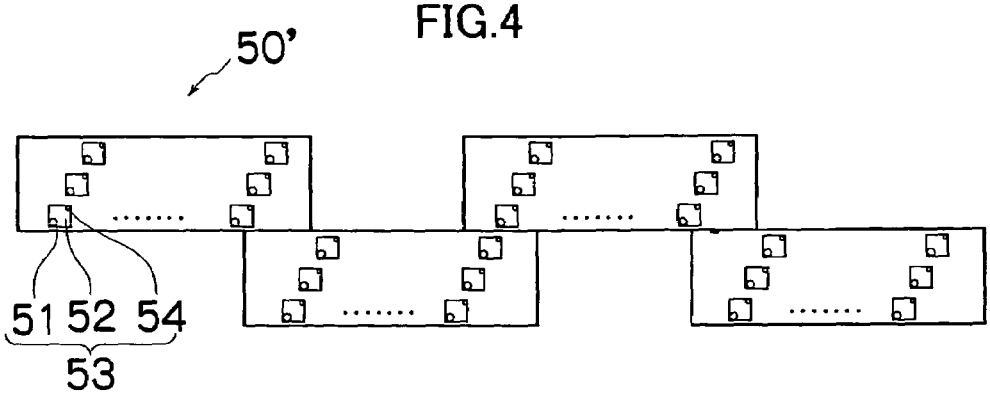
FIG. 4 is a plan view perspective diagram showing a further embodiment of the structure of a head.
Figure 5:
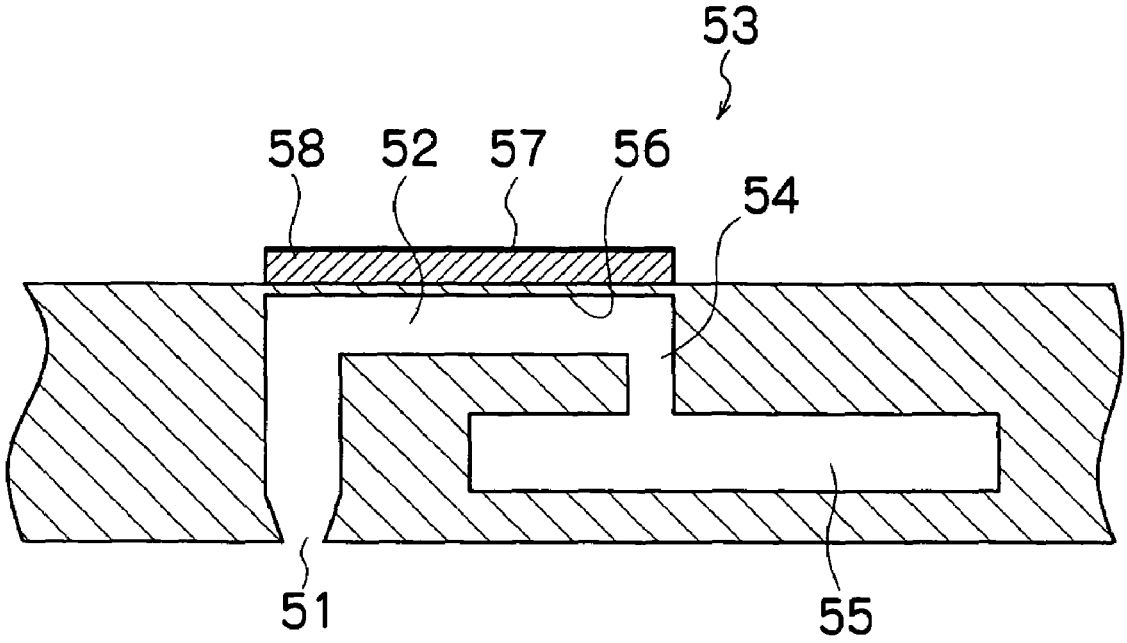
FIG. 5 is a cross-sectional diagram along line 5-5 in FIGS. 3A and 3B.

FIG. 3A is a perspective plan view showing an embodiment of the configuration of the head 50, FIG. 3B is an enlarged view of a portion thereof, FIG. 4 is a perspective plan view showing another embodiment of the configuration of the head 50, and FIG. 5 is a cross-sectional view taken along the line 5-5 in FIGS. 3A and 3B, showing the inner structure of a droplet ejection element (an ink chamber unit for one nozzle 51).

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the embodiment described above. For example, instead of the configuration in FIG. 3A, as shown in FIG. 4, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

As shown in FIGS. 3A and 3B, the planar shape of the pressure chamber 52 provided for each nozzle 51 is substantially a square, and an outlet to the nozzle 51 and an inlet of supplied ink (supply port) 54 are disposed in both corners on a diagonal line of the square. The planar shape of the pressure chamber 52 is not limited to that described in the present embodiment, thus various shapes such as a square (rhombus, rectangle, or the like), pentagon, hexagon, other polygonal shapes, circle, and oval shape are possible.

As shown in FIG. 5, each pressure chamber 52 is connected to a common channel 55 through the supply port 54. The common channel 55 is connected to an ink tank (not shown in FIG. 4), which is a base tank that supplies ink, and the ink supplied from the ink tank 60 is delivered through the common flow channel 55 in FIG. 5 to the pressure chambers 52.

An actuator 58 provided with an individual electrode 57 is bonded to a pressure plate 56 (a diaphragm) which forms a part of (the ceiling in FIG. 5) of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

Figure 6:
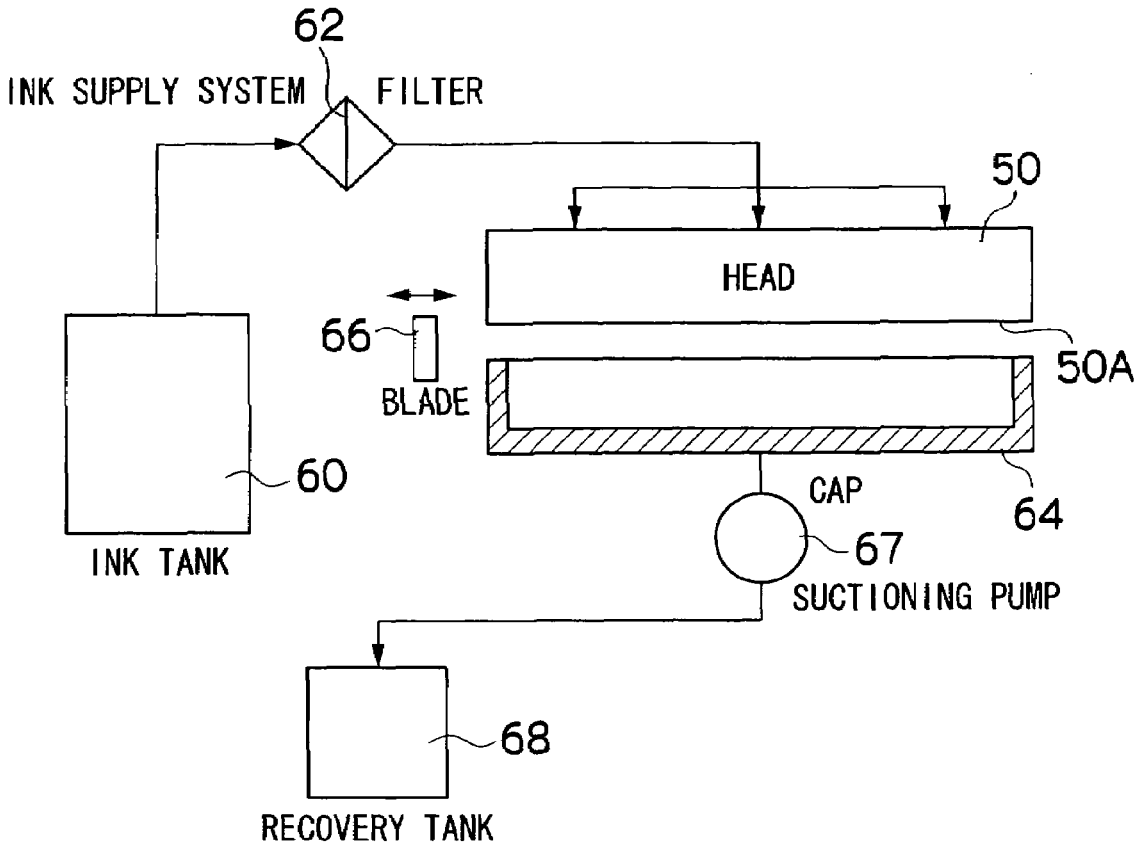
FIG. 6 is a schematic drawing showing the composition of an ink supply system in the inkjet recording apparatus according to an embodiment.

FIG. 6 is a schematic drawing showing the configuration of the ink supply system in the inkjet recording apparatus 10. The ink tank 60 is a base tank for supplying ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed in the middle of a duct that links the ink tank 60 to the print head 50 as shown in FIG. 6. The filter mesh size in the filter 62 is preferably equivalent to or less than the diameter of the nozzle of the nozzle head 50 and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles, and a wiper blade (cleaning blade) 66 as a device to clean the nozzle face 50A.

A maintenance unit comprising a cap 64 and a wiper blade 66 are arranged outside the conveyance path of the recording medium 16, and the print head 50 is moved to a wiping position by a head movement device, which is not shown in the drawings. Alternatively, the maintenance unit may be designed to be movable with respect to the print head 50, in such a manner that the maintenance unit is moved to a maintenance position below the print head 50 from a prescribed withdrawn position, as and when necessary.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to make tight contact with the print head 50, and the nozzle region of the nozzle surface 50A is thereby covered by the cap 64.

The wiper blade 66 is composed by an elastic member made of rubber, a porous body or resin, and can slide in the recording medium conveyance direction on the ink ejection surface (nozzle surface 50A) of the print head 50 by means of a blade movement device. There are no particular restrictions on the blade movement device, but it is also suitable to use, for example, a ball screw conveyance device, a belt and pulley conveyance device, a rack and pinion conveyance device, or the like.

If there are ink droplets or foreign matter adhering to the nozzle surface 50A, then the nozzle surface 50A is wiped by causing the wiper blade 66 to slide over the nozzle surface 50A, thereby cleaning same. A plurality of wiper blades 66 provided respectively for the print heads 50 of the respective colors (12K, 12C, 12M, 12Y) may be moved in a unified fashion, or they may be used respectively and individually.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed into the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by suction is sent to a recovery tank 68. This suction operation is also carried out in order to suction and remove degraded ink which has hardened because of increasing in viscosity when ink is loaded into the print head for the first time, and when the use of the print head is started after having been out of use for a long period of time.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the pressure generating devices (piezoelectric elements) for driving ejection are operated. Therefore, before a state of this kind is reached (while the ink is in a range of viscosity which allows ink to be ejected by means of operation of the pressure generating devices), a "preliminary ejection" is carried out, whereby the pressure generating devices are operated and the ink in the vicinity of the nozzles, which is of raised viscosity, is ejected toward the ink receptacle. Furthermore, after cleaning away soiling on the surface of the nozzle surface 50A by means of a wiper, such as the cleaning blade 66, provided as a cleaning device for the nozzle surface 50A, a preliminary ejection is also carried out in order to prevent infiltration of foreign matter into the nozzles 51 because of the rubbing action of the wiper. The preliminary ejection is also referred to as "dummy ejection", "purge", "liquid ejection", and so on.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed into the ink inside a nozzle 51 and a pressure chamber 52, or when the ink viscosity in inside a nozzle 51 is increased to a certain level or higher, ink can no longer be ejected from the nozzle even if the laminated pressure generating devices are operated. In a case of this kind, a cap 64 is placed on the nozzle surface 50A of the print head 50, and the ink containing air bubbles or the ink of increased viscosity inside the pressure chamber 52 is suctioned by a pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor. The cap 64 illustrated in FIG. 6 functions as a suctioning device and it can also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Next, the cleaning device for a print head according to the present embodiment is described below in detail.

Figure 7:
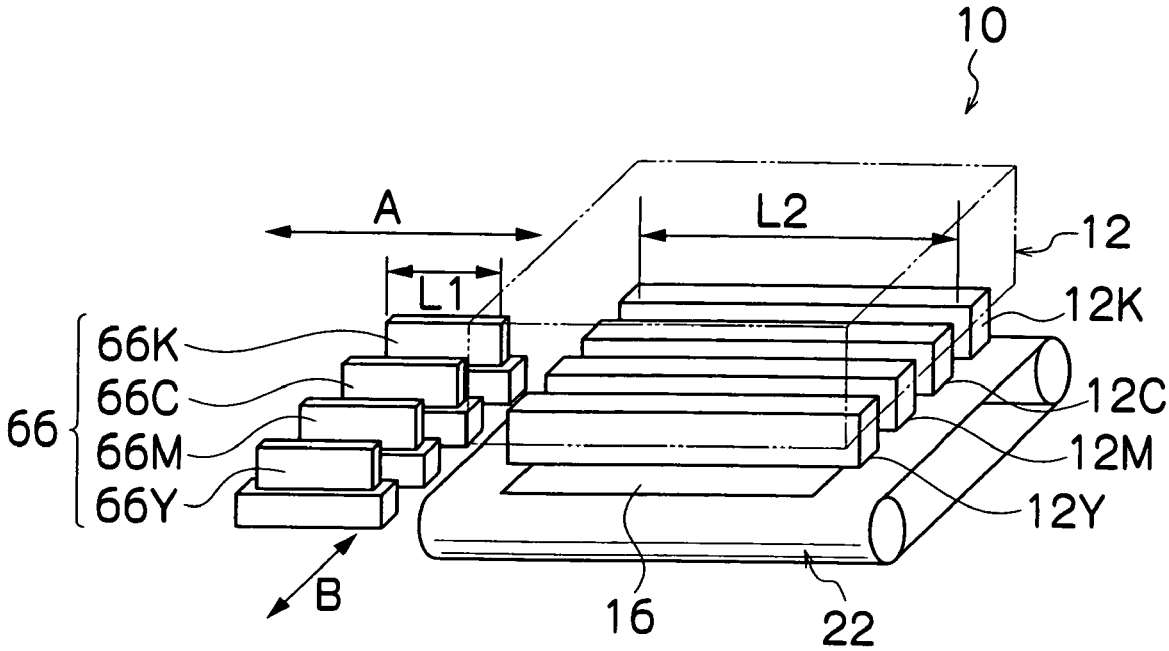
FIG. 7 is an oblique diagram showing the relationship between wiper blades and print heads according to a first embodiment of the present invention.

FIG. 7 is an oblique diagram showing the relationship between the print heads and the cleaning device (wiper blades).

As shown in FIG. 7, in the inkjet recording apparatus 10 according to the present embodiment, a suction belt conveyance unit 22 which conveys a recording paper 16 in a parallel fashion is provided facing the print unit 12 comprising the print heads 12Y, 12M, 12C and 12K of the respective colors, and the wiper blades 66 (66Y, 66M, 66C, 66K) are arranged so as to correspond with the print heads 12Y, 12M, 12C, 12K respectively, in parallel with the print unit 12, on the outside of the recording region.

During head cleaning (wiping), the print unit 12 is moved to a wiping position as indicated by the arrow A shown in FIG. 7, by the head movement device, which is not shown in the drawing.

Furthermore, during the wiping, the wiper blades 66 are moved in the conveyance direction of the recording medium as indicated by arrow B in FIG. 7, by means of a wiper movement device, which is not shown in FIG. 7, in such a manner that they are caused to wipe over the nozzle surfaces of the respective print heads 12Y, 12M, 12C, 12K. Since wiping is performed in the conveyance direction of the recording medium, banding and the like due to bending of the flight of the ejected ink in the direction perpendicular to the conveyance direction of the recording medium are not liable to occur. Therefore print quality is improved.

Furthermore, as shown in FIG. 7, the length L1 of the wiper blades 66 is shorter than the length L2 of the nozzle section of each of the print heads 12Y, 12M, 12C and 12K. Since the length L1 of the wiper blades 66 is made shorter than the length L2 of the nozzle sections, then the wiper blades 66 make tight contact uniformly with the nozzle surfaces of the print heads 12Y, 12M, 12C and 12K, and can therefore reliably wipe away the adhering ink. Moreover, if each of the wiper blades 66 and the suctioning cap section 64 are arranged in alignment in a direction perpendicular to the conveyance direction of the recording medium, then it is possible to reduce the size of the apparatus in accordance with the shortening of the length of the wiper blades.

Figure 8:
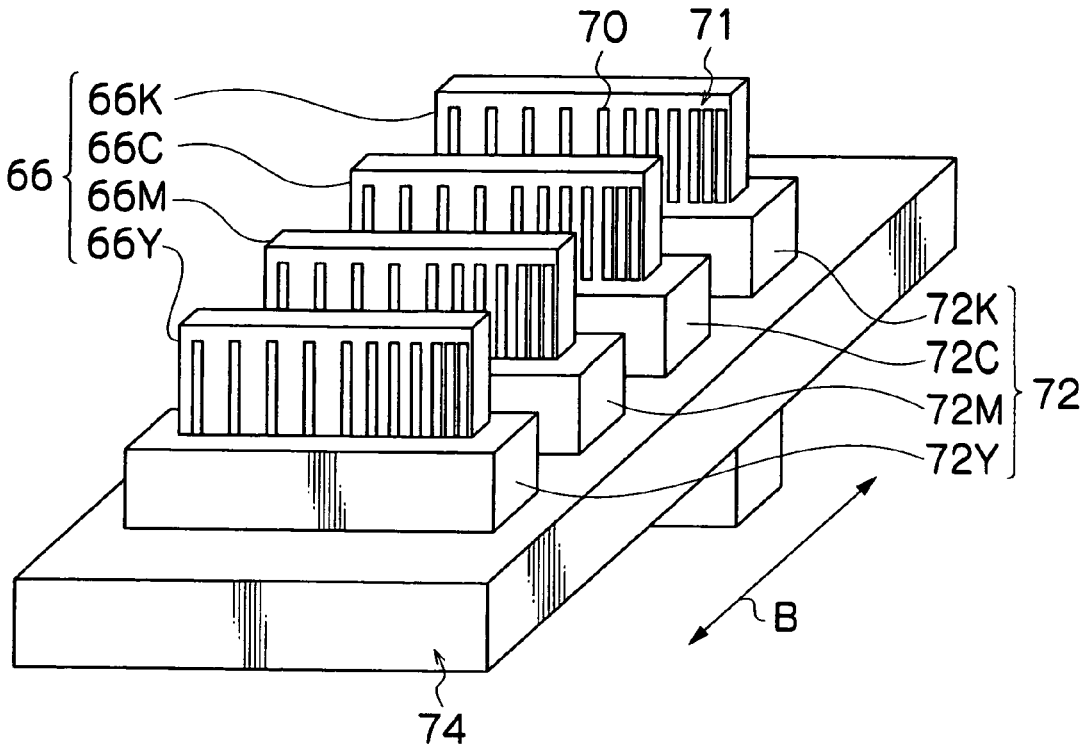
FIG. 8 is an oblique diagram showing an enlarged view of the wiper blades in FIG. 7.

FIG. 8 is an oblique enlarged view of the wiper blades 66.

As shown in FIG. 8, the wiper blades 66 (66Y, 66M, 66C, 66K) are attached to supporting members 72 (72Y, 72M, 72C, 72K), and the supporting members 72 (72Y, 72M, 72C, 72K) are attached to the top of a wiper moving device 74. There are no particular restrictions on the wiper movement device 74, and suitable system embodiments of the wiper movement device 74 include, for example, a ball screw conveyance device, a belt and pulley conveyance device, a rack and pinion conveyance device, and the like.

The wiper movement device 74 moves the wiper blades 66 in a unified fashion in the conveyance direction of the recording medium, as indicated by the arrow B in FIGS. 7 and 8. However, rather than moving the wiper blades 66 together in this way, it is also possible to move the wiper blades 66 separately and independently.

The wiper blades 66 are formed by elastic members made of rubber, porous material, resin, or the like, for example, and a plurality of grooves 70 are formed on either surface of each blade. The density of the grooves 70 becomes higher toward the end portion 71 of the wiper blade 66 (i.e., the density of the grooves 70 becomes gradually greater in a direction toward the end portion 71 of the wiper blade 66, as shown FIG. 8).

By forming the grooves 70 so as to have a greater density in one end section 71 of a wiper blade 66 in this way, rather than uniformly, then the end section 71 where there is a large number of grooves 70 has good ink removing properties because of the capillary action of the grooves 70. Furthermore, since the residual ink which is not removed from a wiper blade 66 is guided to the side where the grooves 70 are formed at low density, then it is possible to prevent ink from spilling out from the wiper blade 66 onto the nozzle surface corresponding to the side where the grooves are formed at high density. Hence the reliability of ejection from the nozzles on the high-density side after wiping can be improved.

FIGS. 9A to 9C and FIGS. 10A to 10C show further embodiments of the composition of a wiper blade 66.

Figure 9A:
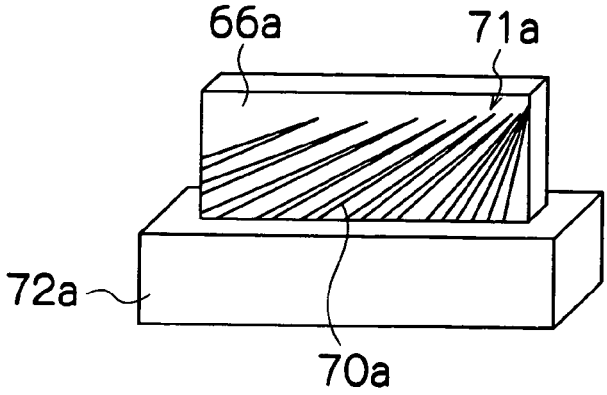
FIGS. 9A to 9C are oblique diagrams respectively showing further embodiments of the wiper blade.

Firstly, in the embodiment of a wiper blade 66 shown in FIG. 9A, grooves 70*a* are formed in a radiating shape obliquely from the upper end of the blade (from the upper right end of the blade in terms of the diagram) in the wiper blade 66*a* fixed to a supporting member 72*a*. The number of grooves 70*a* becomes greater and hence the groove density increases, toward the right end section 71*a* of the blade (i.e., the density of the grooves 70*a* becomes gradually greater in a direction toward the right end section 71*a* of the wiper blade 66*a*). Consequently, the ink removing properties are better in the right end section 71*a* where there are a large number of grooves 70*a*.

Figure 9B:
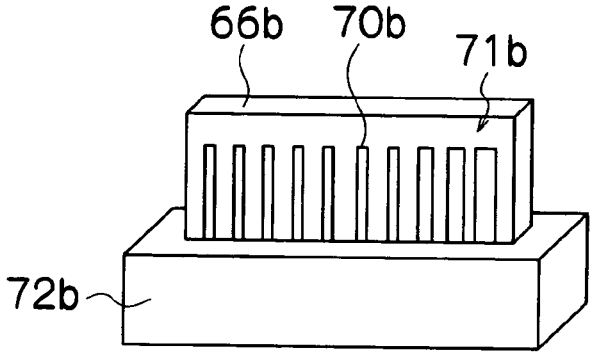

Furthermore, in the embodiment shown in FIG. 9B, parallel grooves 70*b* are formed in a wiper blade 66*b* on a supporting member 72*b*, and the width of the grooves 70*b* increases progressively toward the right end section 71*b*. Accordingly, the ink removing properties are better in the right end section 71*b*.

Figure 9C:
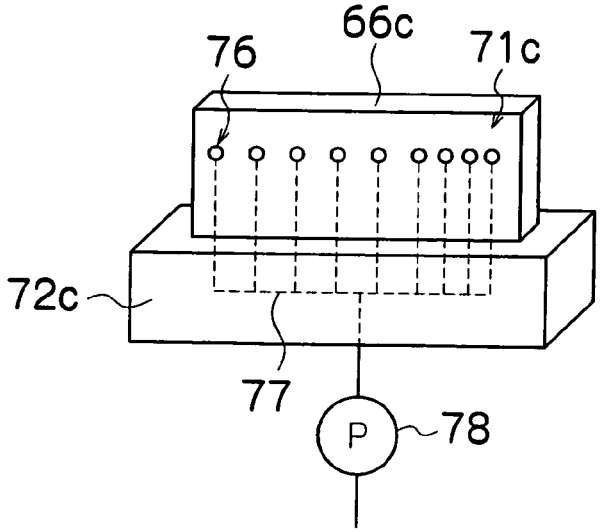

Furthermore, in the embodiment shown in FIG. 9C, a plurality of holes 76 are provided in a surface of a wiper blade 66*c* on a supporting member 72*c*, in such a manner that the density of the holes is progressively higher in a direction toward one end section 71*c* of the blade (i.e., the nearer the one end section 71*c* of the blade, the higher the density of the holes), and in such a manner that ink wiped off by the wiper blade 66*c* can be suctioned through the holes 76 by a suction device (e.g., pump) 78 via a suction path 77. In this embodiment, since the number of holes 76 for suctioning becomes greater progressively toward the right end section 71*c*, then the ink removing properties also improve toward this end section.

By carrying out suctioning to actively gather waste ink after wiping, the waste ink produced by wiping can be discarded readily. Furthermore, the wiper blade 66*c* is maintained in a clean state at all times, flying scattering of ink caused by the restoring action of the wiper blade 66*c* due to its elastic properties is reduced, and increased viscosity and solidification of the residual ink can be prevented.

Figure 10A:
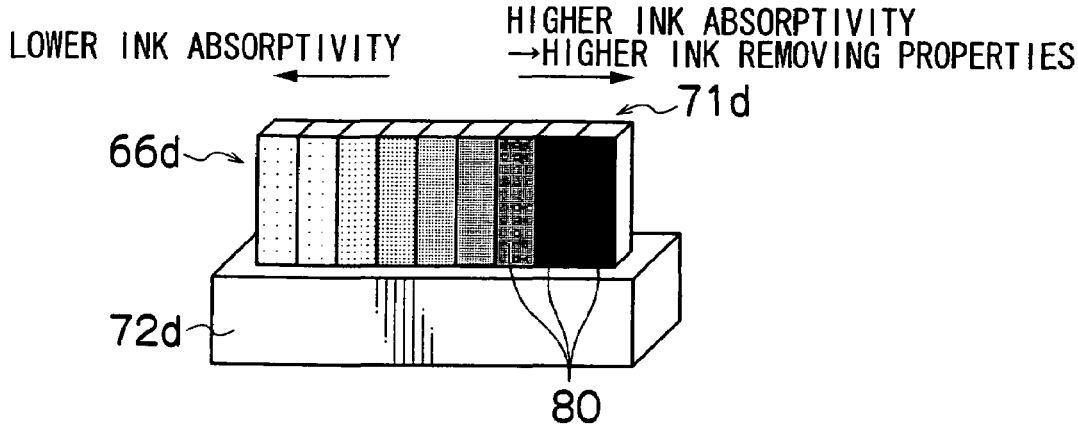
FIGS. 10A to 10C are oblique diagrams respectively showing further embodiments of the wiper blade.

Next, in the embodiment shown in FIG. 10A, a wiper blade 66*d* is constituted by joining together a plurality of porous members 80, in such a manner that porous members 80 having higher ink absorptivity are used toward one end section 71*d* (the nearer the one end section 71*d*, the greater the ink absorptivities of the porous members 80). Thereby, the ink absorptivity becomes larger in the right end section and hence the ink removing properties are greater in this section. Consequently, it is possible to increase the ink absorptivity of the wiper blade 66*d*, and hence to improve the nozzle restoration properties during wiping of a nozzle surface, by means of the capillary action of the porous members 80.

Figure 10B:
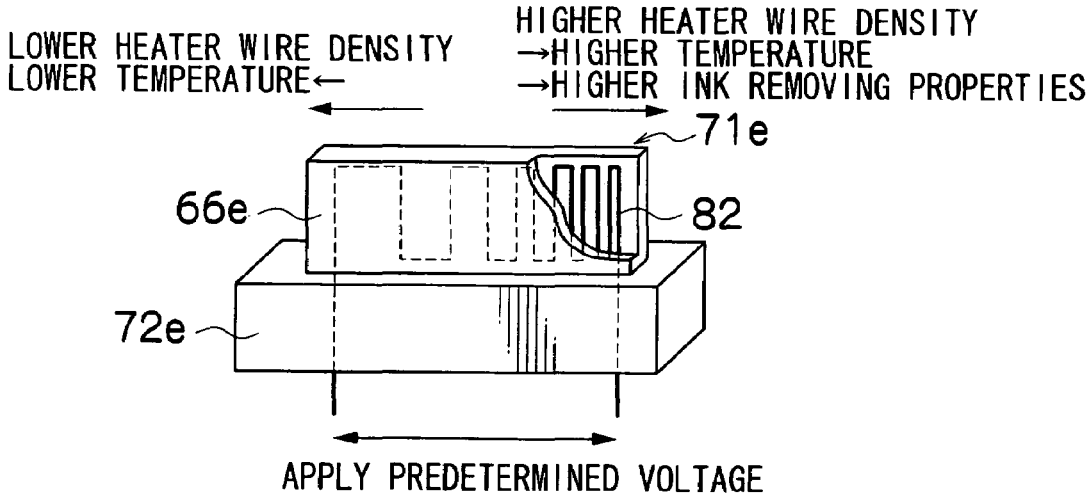

Furthermore, in the embodiment shown in FIG. 10B, a heater 82 is provided in the wiper blade 66*e*, and the density of the heater wires is increased toward the position of one end section 71*e* (the nearer the one end section 71*e*, the greater the density of the heater wires), in such a manner that the temperature increases toward that end section 71*e* (the nearer the one end section 71*e*, the higher the temperature). Accordingly, when a high-viscosity ink of 10 mPa·s or above is used, for example, it is possible to reduce the viscosity of the ink by raising the temperature of the ink, and hence the wiping characteristics can be improved. Moreover, by providing a differential in the fluidity within the wiper blade 66*e*, a differential in ink removing properties is created, and therefore it is possible to reduce the ink which spills out from the end section 71*e* of the wiper blade 66*e*.

Figure 10C:
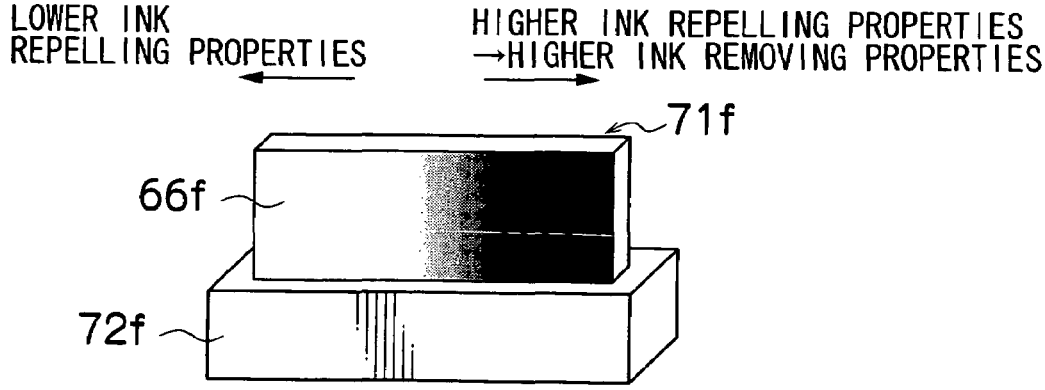

Furthermore, in the embodiment shown in FIG. 10C, a surface of the wiper blade 66*f* is formed to have increased hydrophobic properties toward one end section 71*f* (the nearer the one end section 71*f*, the greater the water repellency of the surface of the wiper blade 66*f*), thereby improving the characteristics of guiding the ink toward the other end section which has lower hydrophobic properties (lower water repellency) and hence increasing the ink removing properties in the right end section 71*f*.

Next, the operation of the wiper blade 66 during wiping is described below.

FIGS. 11A to 14B show the operation of the wiper blade 66 during wiping.

Figure 11B:
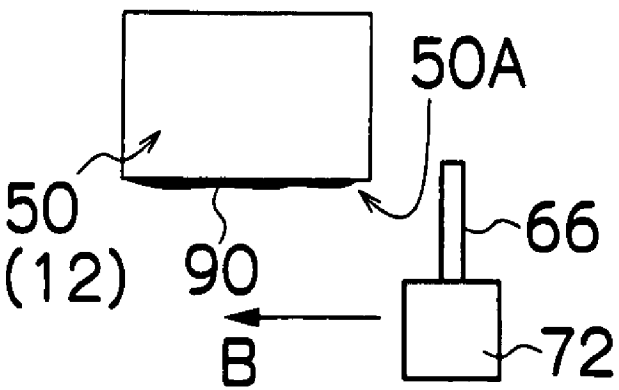
Figure 11A:
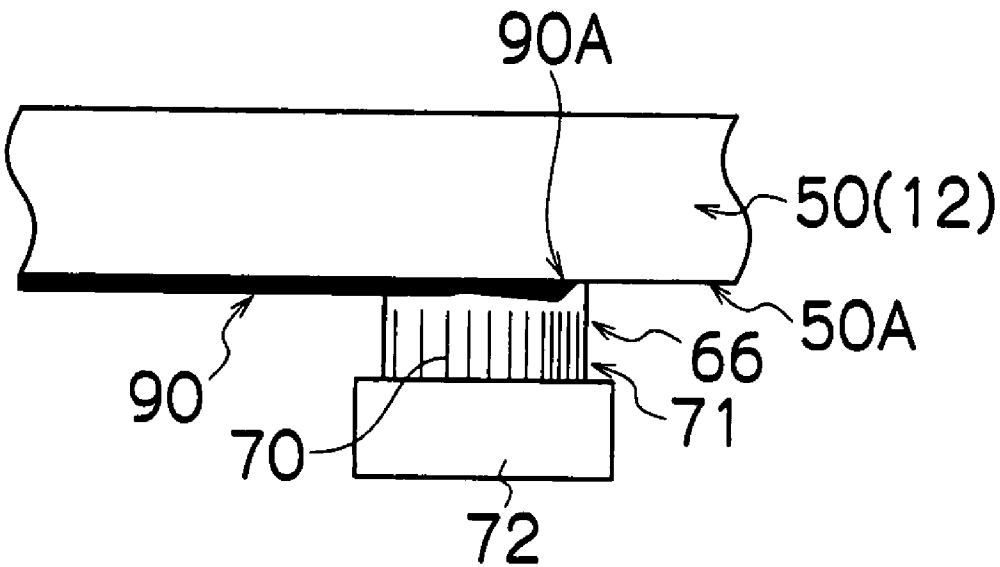

FIGS. 11A and 11B shows a state at the start of wiping. FIG. 11A is a front view diagram and FIG. 11B is a side view diagram.

When wiping starts, the print head 50 (12) is moved in the direction indicated by the arrow A in FIG. 7, by means of the head movement device (not shown in the drawing), and the print head 50 is halted at the wiping start position as shown in FIGS. 11A and 11B.

As shown in FIG. 11A, the wiping start position is a position where the end section 90A of the ink 90 adhering to the nozzle surface 50A of the print head 50 coincides with the right end section 71 of the wiper blade 66 where the grooves 70 formed on a surface of the wiper blade 66 are formed at high density.

Furthermore, in this case, as shown in FIG. 11B, when viewed from the side, the wiper blade 66 is positioned to the rear side of the print head 50, achieving an arrangement whereby, when the wiper blade 66 is subsequently moved in the direction indicated by arrow B during wiping, the front end of the wiper blade 66 is able to wipe away the ink 90 adhering to the nozzle surface 50A of the print head 50.

Figure 12:
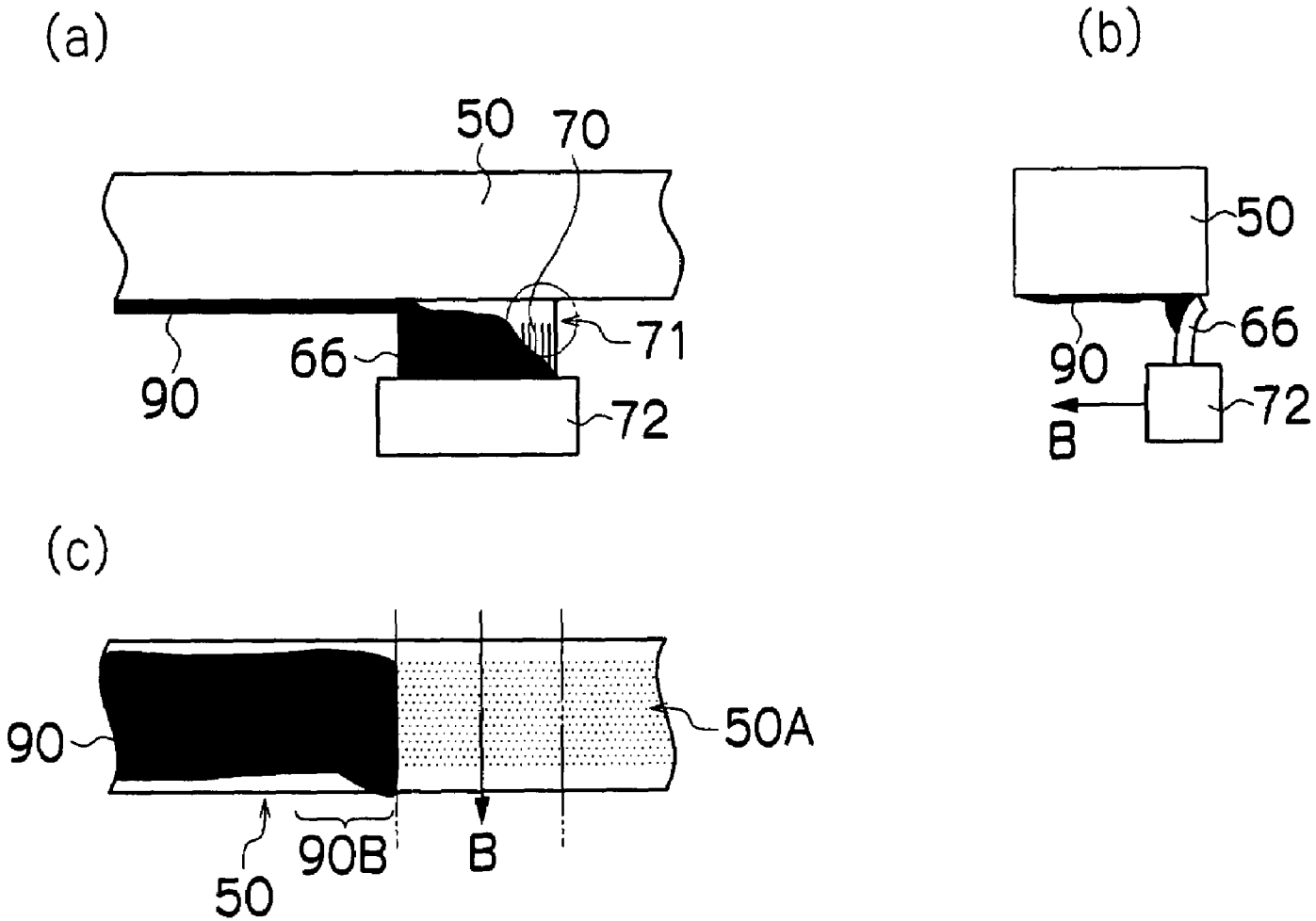
FIG. 12 is an illustrative diagram showing a state during wiping by a wiper blade, wherein the state of (a) in FIG. 12 shows a front view diagram, the state of (b) in FIG. 12 shows a side view diagram, and the state of (c) in FIG. 12 shows a plan view diagram.

FIG. 12 shows a state during wiping. The state of (a) in FIG. 12 is a front view diagram, the state of (b) in FIG. 12 is a side view diagram, and the state of (c) in FIG. 12 is a plan diagram.

During wiping, as shown in (b) in FIG. 12, the wiper blade 66 is moved in the direction of arrow B by means of the wiper movement device 74 (see FIG. 8) which is not shown in (b) in FIG. 12. When observed in front view, the wiper blade 66 is moved from the rear side to the near side of the plane of (a) in FIG. 12. The ink 90 adhering to the nozzle surface 50A of the print head 50 is swept by the wiper blade 66, and it travels along the grooves 70 formed on the surface of the wiper blade 66 and flows downward. In this case, on the side of the wiper blade 66 where grooves 70 are formed at high density on the right end section 71, the ink removing properties are good, and when the wiper blade 66 wipes over a nozzle surface 50A, there is no residual ink 90 left unwiped on the nozzle surface 50A.

Consequently, as shown in (c) in FIG. 12 which depicts a state where the wiper blade 66 has wiped over the nozzle surface 50A in the direction of the arrow B, no residual unwiped ink 90 is left on the nozzle surface 50A after wiping by the wiper blade 66, particularly on the region corresponding to the right-hand side of the wiper blade 66.

Figure 13:
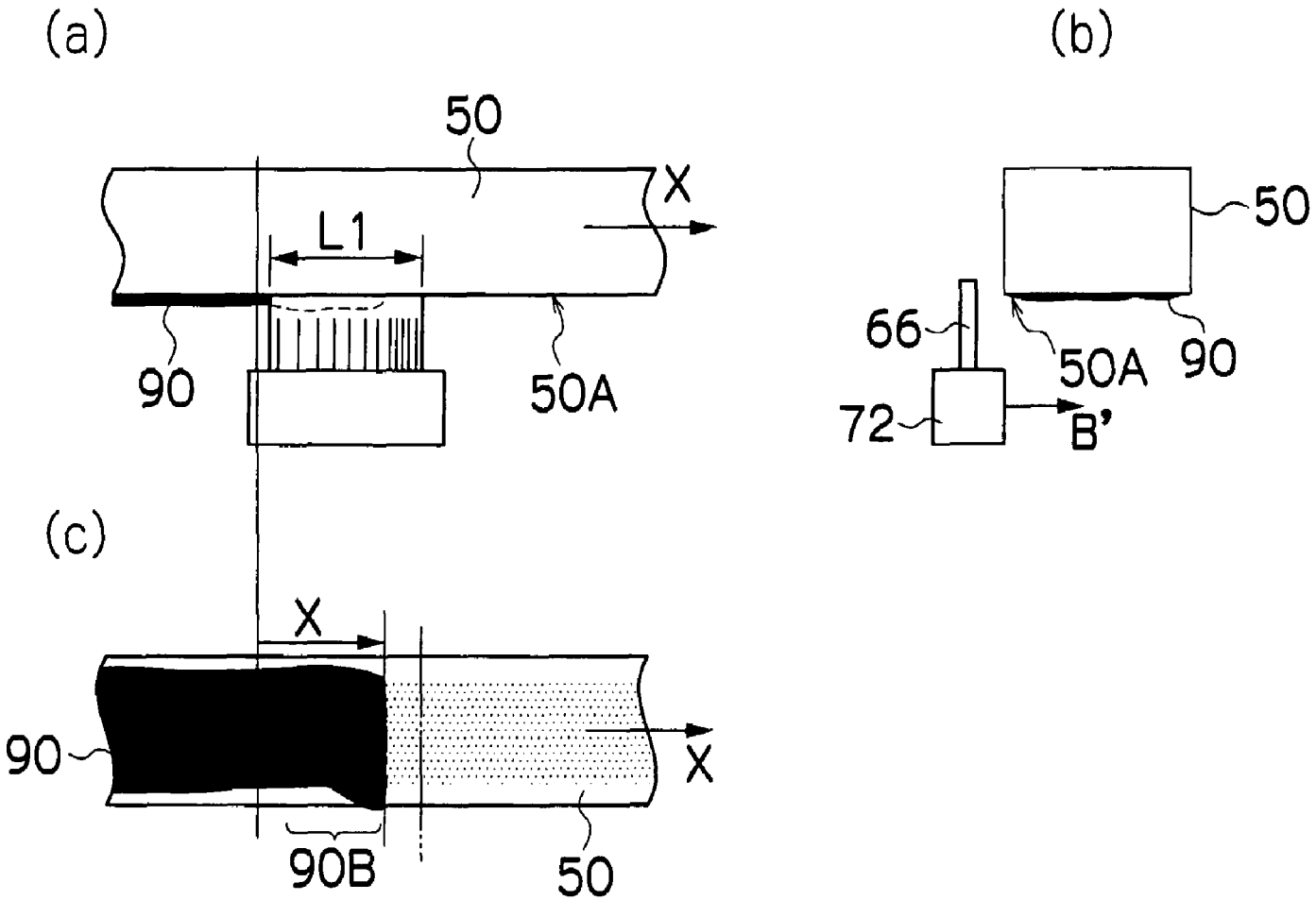
FIG. 13 shows a state where a print head is moved in order to wipe the next section, wherein the state of (a) in FIG. 13 shows a front view, the state of (b) in FIG. 13 shows a side view diagram and the state of (c) in FIG. 13 shows a plan view.

As indicated by the arrow B in (b) in FIG. 12, when the wiper blade 66 has been wiped over the nozzle surface 50A from the rear side of the print head 50 toward the front side (from the right side to the left side in (b) in FIG. 12), the wiper blade 66 is positioned on the opposite side (front surface side) of the print head 50, as shown in (b) in FIG. 13. In this case, the nozzle surface 50A is wiped in the opposite direction, by the opposite surface of the wiper blade 66, as indicated by the arrow B' shown in (b) in FIG. 13.

By means of this wiping action, the ink 90 in the portion 90B to the left-hand side of the portion which is wiped by the previous action as shown in (c) in FIG. 12 is wiped. In this wiping action, as shown (a) and (c) in FIG. 13, the print head 50 is moved by a prescribed amount X which is shorter than the length L1 of the wiper blade 66, in the rightward direction in (a) and (c) in FIG. 13.

Figure 14:
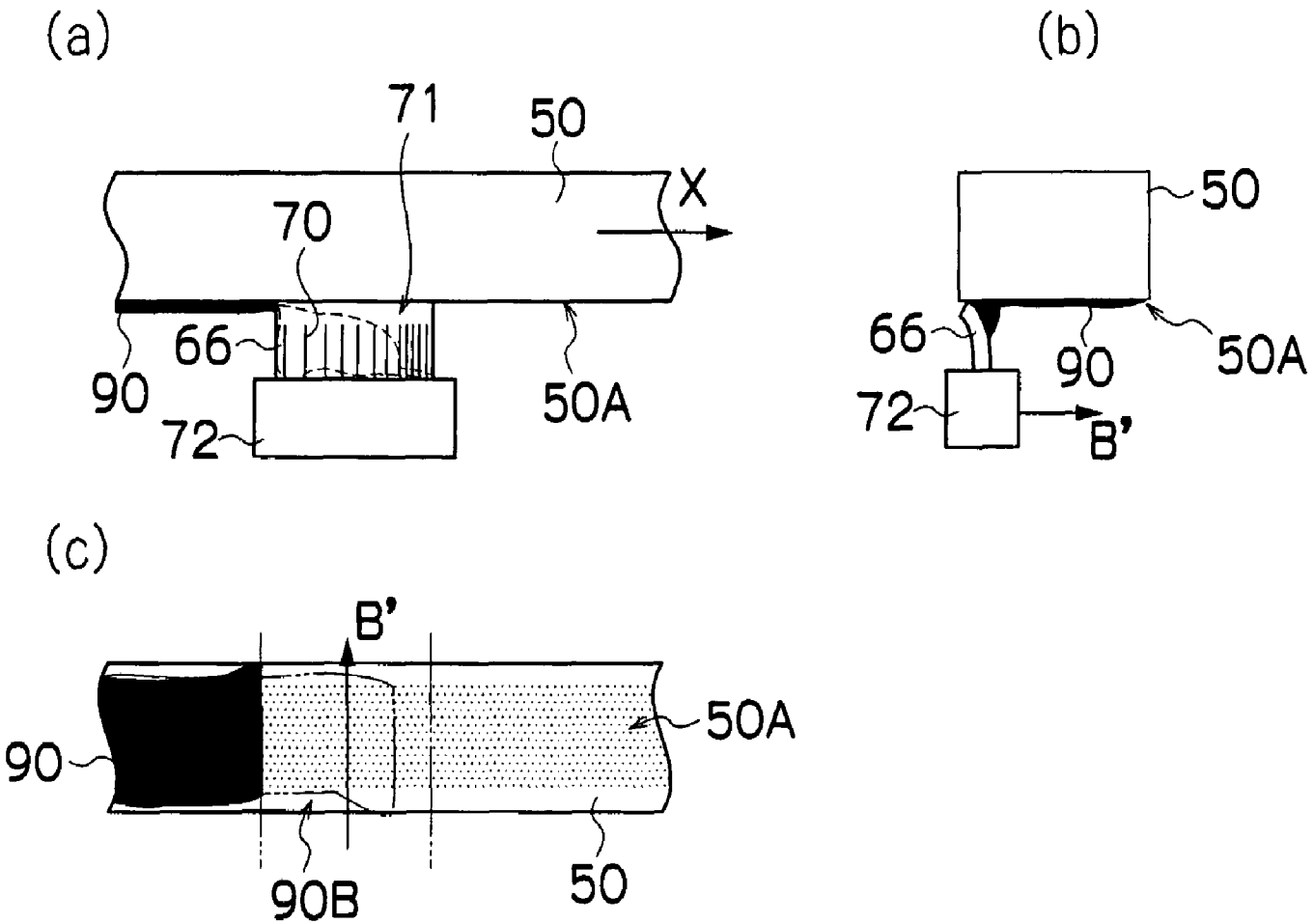
FIG. 14 is an illustrative diagram showing a state during wiping of a next section, wherein the state of (a) in FIG. 14 shows a front view diagram, the state of (b) in FIG. 14 shows a side view diagram, and the state of (c) in FIG. 14 shows a plan view diagram.

As shown in (b) in FIG. 14, the wiper blade 66 is wiped from the front surface side of the print head 50 toward the rear surface side (from the left side to the right side in (b) in FIG. 14) as indicated by the arrow B' in (b) in FIG. 14. In this case, as shown in (a) in FIG. 14, since the ink removing properties are higher in the end section 71 where the grooves 70 are formed at high density in the wiper blade 66 (the grooves are not shown in (a) in FIG. 14 since the adhering ink 90 is wiped away by the far surface of the wiper blade 66 depicted in (a) in FIG. 14), then the residual unwiped ink 90 does not overflow on the right side of the wiper blade 66.

As shown in (c) in FIG. 14, by means of the wiper blade 66 wiping over the nozzle surface 50A in the direction of the arrow B', it is possible to wipe away the ink 90 in the portion indicated by reference numeral 90B, and it is possible to prevent the ink 90 which has already been wiped from spilling out onto the nozzle surface 50A on the high-density side. Consequently, it is possible to remove the ink 90 on the nozzle surface 50A completely, and hence the ejection reliability can be improved.

By repeating, a plurality of times, actions of alternately performing wiping in the B direction and the B' direction, and the head feeding (by a feed amount X), until the whole length of the print head 50 has been wiped, it is possible to wipe the whole of the nozzle surface 50A of the print head 50.

Figure 15:
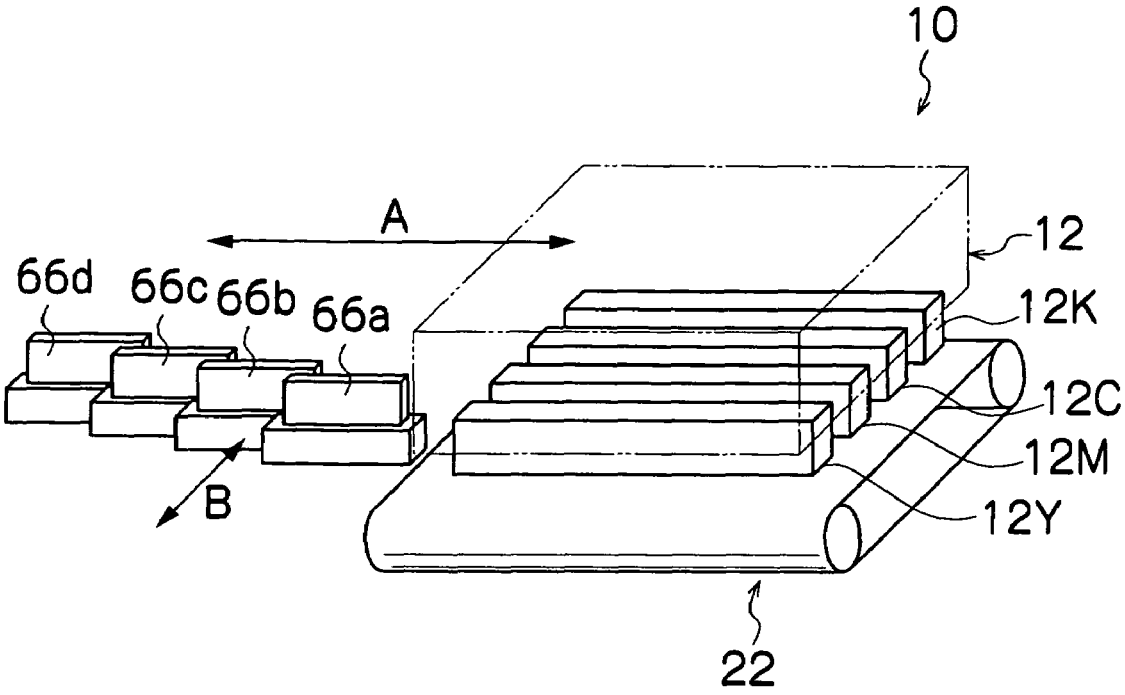
FIG. 15 is an oblique diagram showing a further embodiment of the wiper blade.

In the embodiment described above, one wiper blade 66 of short length is prepared for each of the print heads 50 (12Y, 12M, 12C, 12K), and bidirectional wiping is repeated while the print heads 50 are gradually moved, by a small distance at a time, in the lengthwise direction of the wiping blades 66; however, as shown in FIG. 15, it is also possible to provide a group of wiping blades 66 of short length with respect to each of the print head 50 (12Y, 12M, 12C, 12K) in a staggered and mutually overlapping fashion so as to cover the whole length of the corresponding print head 50. FIG. 15 only depicts the group of wiper blades 66 corresponding to the print head 12Y for yellow ink, as an example, but groups of wiper blades 66 of this kind are arranged respectively for the print heads 12Y, 12M, 12C and 12K.

According to this composition, it is possible to wipe the whole of a nozzle surface 50A by wiping the nozzle surface 50A just once with this group of wiper blades 66 after the print head 50 is moved to a wiping position during wiping. If the blades perform the wiping alternately in two directions, then it is necessary to increase the ink removing properties at one end section of both sides of the wiper blade 66 by forming grooves, or the like, at higher density on the one end section of the both sides; however, if the wiping is performed only once in one direction as in the present embodiment, then a composition of this kind which has increased ink removing properties at one end section only needs to be provided on one side of the wiper blade 66.

Furthermore, in the present embodiment, the print head is moved to a wiping position by means of a head movement device, but the invention is not limited to this. It is also possible to provide the wiper blades with devices for moving them in the direction of arrow A, in such a manner that each of the wiper blades is moved to the wiping position.

Next, a second embodiment of the present invention is described below. In the present embodiment, a nozzle observation device (image recognition device) is provided on the downstream side of the print unit 12 (i.e., after the print unit 12). The print output results are read in as image information by the nozzle observation device, and then the presence or absence of a nozzle suffering an ejection abnormality is determined. If an ejection abnormality nozzle is discovered, then a wiping operation, in which a nozzle surface is wiped, is carried out from the vicinity of that ejection abnormality nozzle.

By adopting this composition, wiping is not carried out with respect to nozzles which are not suffering a particular abnormality and do not require a wiping operation, and therefore, adverse effects based on wiping are not caused to such normal nozzles and the ejection reliability can be improved.

Figure 16:
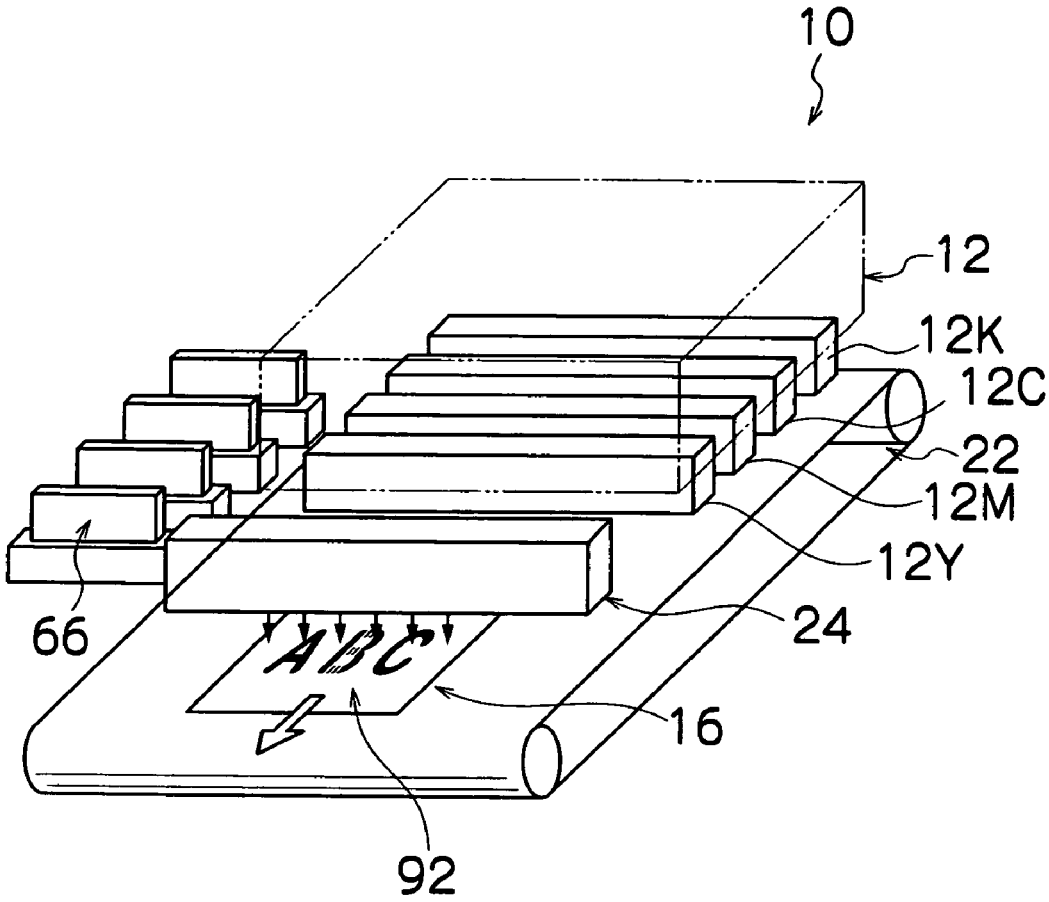
FIG. 16 is an oblique diagram showing a second embodiment of the present invention.

FIG. 16 shows the periphery of a print unit 12 and wiping blades 66 of an inkjet recording apparatus 10 according to the present embodiment.

As shown in FIG. 16, the print determination unit 24 provided on the downstream side of the print unit 12 is used as a nozzle observation device. As stated above, the print determination unit 24 has an image sensor for capturing an image of the droplet ejection result by the print unit 12, and it serves to determine a nozzle suffering a nozzle blockage or other ejection abnormalities according to the droplet ejection image read in by the image sensor.

If an ejection abnormality location 92 which has an abnormality such as banding, is determined on the recording paper 16 by means of the print determination unit 24, and if the corresponding nozzle is taken to be an ejection abnormality nozzle, then the print head 50 is moved to the position corresponding to the ejection abnormality nozzle in such a manner that wiping starts from the position of the ejection abnormality nozzle, and wiping is then started.

In this way, in the present embodiment, since an ejection abnormality nozzle arising during printing is confirmed and wiping is carried out on the basis of the confirmation, then the reliability of the apparatus is improved. Furthermore, since abnormalities are determined on the basis of print output results, then it is possible to improve the print quality.

The nozzle observation device is not limited to one which captures an image of the print results by means of an image sensor as described above; for example, it is also possible to provide sensors which determine pressure change in the vicinity of the nozzles inside the print head 50, or residual vibrations of the piezoelectric elements, or the like. According to these sensors, ejection abnormalities can be determined during printing.

Furthermore, by accommodating a nozzle observation device inside the print head in this way, it is also possible to make the apparatus compact in size.

Moreover, as a nozzle observation device, it is also possible to provide sensors which directly observe the state of flight of the ink droplets ejected from the nozzles, outside the print head 50. According to these sensors, since the state of flight of the ink droplets is observed directly, then the determination accuracy with respect to an ejection abnormality nozzle is excellent.

Next, a third embodiment of the present invention is described below. In this embodiment, the nozzle surface of a print head is observed and a wiping operation (sliding operation) is carried out from a location where there is soiling on the nozzle surface.

Figure 17:
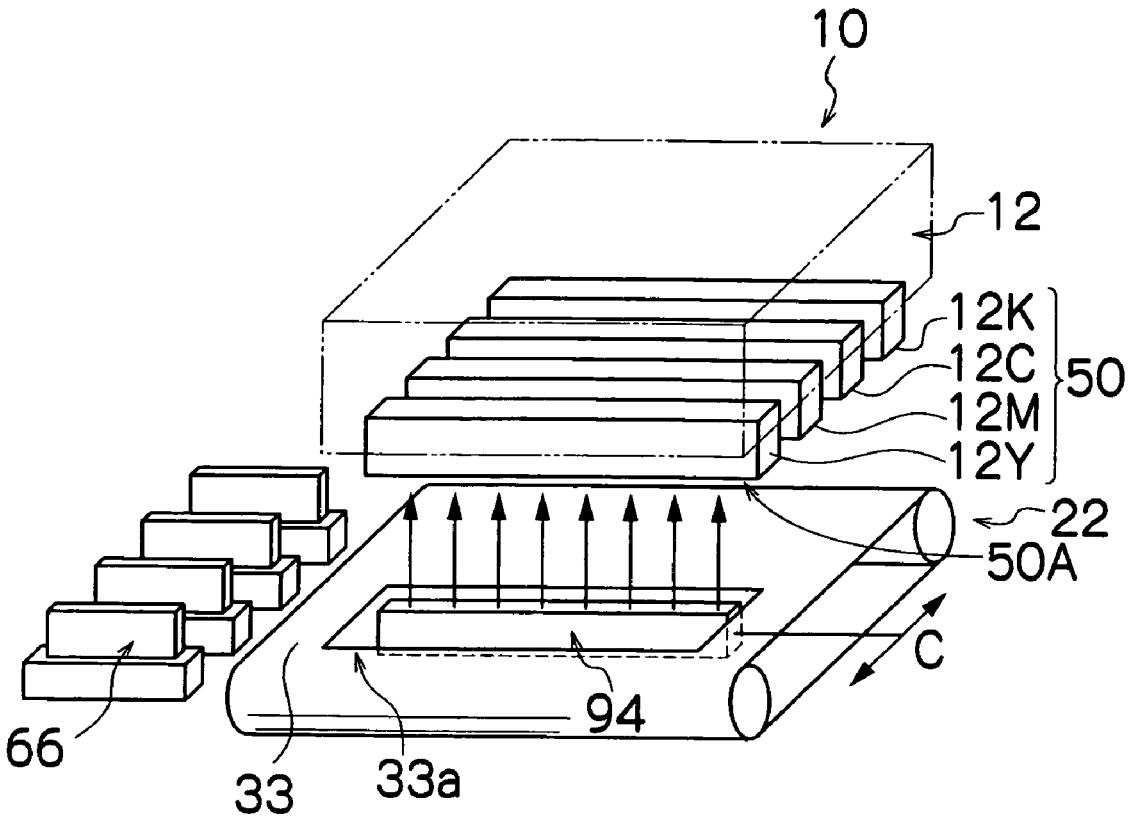
FIG. 17 is an oblique diagram showing a third embodiment of the present invention.

FIG. 17 shows the periphery of a print unit 12 and wiping blades 66 of an inkjet recording apparatus 10 according to the present embodiment.

As shown in FIG. 17, a nozzle observation device 94 is provided at the lower side of the belt 33 of the suction belt conveyance unit 22. There are no particular restrictions on the nozzle observation device 94, and it is, for example, an imaging device, such as a CCD, which observes (captures an image of) the nozzle surface 50A of the print head 50 via a transparent section 33*a* provided in the belt 33. The nozzle observation device 94 is provided movably in a reciprocal fashion in the directions indicated by the arrow C in FIG. 17, by means of a movement device with respect to the conveyance direction of the recording medium.

The nozzle observation device 94 is moved in accordance with the movement of the transparent section 33*a* of the belt 33, and the state of a nozzle surface 50A is observed while the transparent section 33*a* and the nozzle observation device 94 are moved in a position opposing the print head 50.

If, as a result of the observation, the presence of accumulated ink or adherence of foreign material on the nozzle surface 50A is confirmed, then a wiping action is started from the vicinity of same.

According to the present embodiment, abnormalities on the nozzle surface arising during printing can be confirmed, and a wiping operation can be carried out accordingly. Therefore, the reliability of the apparatus can be improved. Furthermore, since wiping is not carried out in respect of normal nozzles which do not require wiping, then it is possible to improve the reliability of wiping.

As described above, in the related art, it has been sought to improve wiping characteristics by uniformly moving ink wiped by the whole region of the front end section of a wiper blade to a position outside the front end section, whereas in embodiments of the present invention, the ink removing properties are increased toward one end portion of the front end section of the wiper blade and the ink remaining on the nozzle surface of the print head is guided to the end portion where the ink removing properties are lower.

Furthermore, in the related art, the wiper blade is a relatively long blade which covers the whole of the nozzle section of a long head, whereas in the present embodiment, it is a wiper blade which is shorter than the nozzle section of the print head.

Therefore, when the region of the long head is divided into several sections and the divided sections are wiped in a successive fashion, it is possible to guide ink remaining on the nozzle surface toward a section that is to be wiped next (namely, a section near the end side having lower ink removing properties), and hence ink does not remain on the nozzle surface of the section which has previously been wiped.

Furthermore, when a long head is wiped in the conveyance direction of the recording medium, a short wiper blade can more readily be made to contact the head tightly in a uniform fashion, and hence the occurrence of residual unwiped ink can be reduced and therefore print quality can be stabilized. Moreover, in a mode where the print head is moved to a region outside the recording section and is then wiped, the apparatus can be reduced in size in accordance with the reduced length of the wiper blade.

Furthermore, if, in particular, an ejection abnormality nozzle or a soiled location on the nozzle surface is determined and wiping is started from there, then normal nozzles are not wiped unnecessarily from the wiping start position through to the region where wiping is not required, and hence the reliability of ink ejection can be improved.

Inkjet recording apparatuses according to the present invention has been described in detail above; however, the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

an inkjet recording head having a long side extending in a lengthwise direction corresponding to a first movement direction perpendicular to a paper conveyance direction;

a wiper blade which wipes a nozzle surface of the inkjet recording head in which a nozzle is formed;

a first movement device which moves one of the inkjet recording head and the wiper blade in the first movement direction; and a second movement device which moves the wiper blade in a second movement direction which is substantially perpendicular to the first movement direction, in such a manner that the wiper blade wipes the nozzle surface, wherein the wiper blade is formed in such a manner that ink removing properties of at least one surface of the wiper blade become higher toward a first end section of the wiper blade in the first movement direction.

2. The inkjet recording apparatus as defined in claim 1, wherein a length of the wiper blade is shorter than a length of the nozzle surface of the inkjet recording head in the lengthwise direction.

3. The inkjet recording apparatus as defined in claim 2, further comprising an operational control device which controls the first movement device and the second movement device in such a manner that a first operation of wiping the nozzle surface by moving the wiper blade in the second movement direction, and a second operation of moving the wiper blade by a prescribed distance which is shorter than the length of the wiper blade in a direction which corresponds to both of the first movement direction and a direction from the first end section of the wiper blade toward a second end section of the wiper blade which is opposite to the first end section are alternately repeated, wherein the nozzle surface is wiped in such a manner that the first operation of wiping the nozzle surface is successively repeated in a direction from the first end section toward the second end section of the wiper blade.

4. The inkjet recording apparatus as defined in claim 2, further comprising an operational control device which controls the first movement device and the second movement device in such a manner that a first operation of wiping the nozzle surface by moving the wiper blade in the second movement direction, and a second operation of moving the inkjet recording head by a prescribed distance which is shorter than the length of the wiper blade in a direction which corresponds to both of the first movement direction and a direction from a second end section of the wiper blade which is opposite to the first end section toward the first end section of the wiper blade are alternately repeated, wherein the nozzle surface is wiped in such a manner that the first operation of wiping the nozzle surface is successively repeated in a direction from the first end section toward the second end section of the wiper blade.

5. The inkjet recording apparatus as defined in claim 1, wherein the wiper blade has a plurality of grooves formed in the at least one surface of the wiper blade in such a manner that density of the grooves becomes higher toward the first end section.

6. The inkjet recording apparatus as defined in claim 1, wherein the wiper blade has a plurality of grooves formed in the at least one surface of the wiper blade in such a manner that width of the grooves becomes broader toward the first end section.

7. The inkjet recording apparatus as defined in claim 1, wherein the wiper blade has a plurality of holes via which ink is suctioned by means of a suctioning device, in the at least one surface of the wiper blade, in such a manner that density of the holes becomes higher toward the first end section.

8. The inkjet recording apparatus as defined in claim 1, wherein the wiper blade includes a plurality of porous members joined together in such a manner that ink absorptivities of the respective porous members become higher toward the first end section.

9. The inkjet recording apparatus as defined in claim 1, wherein the wiper blade includes a heater which provides the wiper blade with a temperature gradient in such a manner that temperature of the wiper blade becomes higher toward the first end section.

10. The inkjet recording apparatus as defined in claim 1, wherein water repellency properties of the at least one surface of the wiper blade becomes higher toward the first end section.

11. The inkjet recording apparatus as defined in claim 1, wherein a plurality of the nozzles are formed in the nozzle surface;

the inkjet recording apparatus further comprises a first nozzle observation device which observes an ejection state of the nozzle; and if it has been determined by the first nozzle observation device that at least one of the nozzles suffers an ejection abnormality, a wiping operation is started from a region of the nozzle surface containing the at least one of the nozzles suffering the ejection abnormality.

12. The inkjet recording apparatus as defined in claim 1, further comprising a second nozzle observation device which observes the nozzle surface, wherein, if soiling on the nozzle surface has been determined by the second nozzle observation device, a wiping operation is started from a region of the nozzle surface containing an area of the soiling.

* * * * *